US005692394A

United States Patent [19]

Ozaki et al.

[11] Patent Number: 5,692,394

[45] Date of Patent: Dec. 2, 1997

[54] GAS-LIQUID SEPARATOR FOR A HEAT PUMP TYPE AIR CONDITIONING SYSTEM USING A GAS-INJECTION CYCLE

[75] Inventors: Yukikatsu Ozaki; Masaru Tsunokawa, both of Nishio, Japan

[73] Assignee: Nippon Soken, Inc., Nishio, Japan

[21] Appl. No.: 706,329

[22] Filed: Aug. 30, 1996

[30] Foreign Application Priority Data

Aug. 31, 1995 [JP] Japan ..... 7-224046

[51] Int. Cl.[6] ..... F25B 39/04

[52] U.S. Cl. ..... 62/509; 62/512

[58] Field of Search ..... 62/503, 509, 512

[56] References Cited

U.S. PATENT DOCUMENTS 4,232,533 11/1980 Lundblad et al. ..... 62/509
4,831,835 5/1989 Beehler et al. ..... 62/509

FOREIGN PATENT DOCUMENTS 63-7745 1/1988 Japan .
63-61853 3/1988 Japan .
5-141814 6/1993 Japan .

*Primary Examiner*—William E. Tapolcai

*Attorney, Agent, or Firm*—Cushman, Darby & Cushman, IP Group of Pillsbury Madison & Sutro LLP

[57] ABSTRACT

A gas-liquid separator for a heat pump type air conditioning system using a gas-injection cycle, which system can switch its mode of operation between heating and cooling modes, includes a reservoir for receiving refrigerant in a gas-liquid two-phase flow, an exit port which opens at a upper portion of the reservoir and allows a refrigerant gas to flow out of the reservoir, first and second ports which are provided at a upper part within the reservoir above the level of a refrigerant liquid and allows the refrigerant to flow into and out of the reservoir. A first refrigerant path for allowing the first port to fluidly communicate with the refrigerant liquid in the reservoir, a second refrigerant path for allowing the first port to fluidly communicate with the refrigerant gas above the level of the refrigerant liquid in the reservoir, a third refrigerant path for allowing the second port to fluidly communicate with the refrigerant liquid in the reservoir, and a fourth refrigerant path for allowing the second port to fluidly communicate with the refrigerant gas above the level of the refrigerant liquid in the reservoir are provided within the reservoir. The second and third refrigerant path open when a refrigerant enters the reservoir through the first port, and the first and fourth refrigerant path open when a refrigerant enters the reservoir through the second port.

6 Claims, 8 Drawing Sheets

GAS-LIQUID SEPARATOR FOR A HEAT PUMP TYPE AIR CONDITIONING SYSTEM USING A GAS-INJECTION CYCLE

BACKGROUND OF THE INVENTION

1. Field of the Invention

The invention relates to a gas-liquid separator for a heat pump type air conditioning system, using a gas-injection cycle, which is capable of switching the operation mode between cooling and heating modes.

2. Description of the Related Art

Japanese Unexamined Utility Model Publication (Kokai) No. 63-7754 discloses a heat pump type air conditioning system capable of switching the operation mode between cooling and heating modes. The air conditioning system is provided with a 4-direction valve, at an discharge port of a compressor, for switching the operation mode between cooling and heating. Further, Japanese Unexamined Patent Publication No. 63-61853 discloses an air conditioning system which switches the rotational direction for switching the operation mode between cooling and heating.

A gas-injection cycle, which is known in the art, increases the efficiency of an air conditioning system. Gas-liquid separator for using in a gas-injection cycle includes a reservoir for receiving a refrigerant from an expansion valve. An inlet port which is fluidly connected to the expansion valve is provided at a upper position of the reservoir. The refrigerant which flows into the reservoir through the inlet port is separated into refrigerant gas and liquid. The separated refrigerant gas is directed to an suction port of the compressor through a gas exit port which is provided at a position higher than the level of the refrigerant liquid within the reservoir. The remaining refrigerant liquid is directed to an evaporator through a conduit which is provided at a position lower than the level of the refrigerant liquid within the reservoir and through a second expansion valve. The air conditioning system with a prior art gas-liquid separator is provided with a number of pipes arranged around the separator for switching the operation mode. Thus, the prior art air conditioning system of a gas-injection cycle with a gas-liquid separator encounters a problem that the piping around the separator is complex, which increases the production cost.

SUMMARY OF THE INVENTION

The invention is directed to solve the prior art described above, and to provide a gas-liquid separator improved to reduce the production cost of a heat pump type air conditioning system.

The invention claimed in claim 1 provides a gas-liquid separator for heat pump type air conditioning system, using a gas-injection cycle, which system can switch its mode of operation between heating and cooling modes. In the gas-liquid separator, a second refrigerant path (20), from a first port (11) to the refrigerant gas above the level of the refrigerant liquid in the reservoir (10), and a third refrigerant path (28), from the second port (12) to the refrigerant liquid in the reservoir (10), open when a refrigerant flows into the reservoir (10) through the first port (11).

A first refrigerant path (19), from the first port (11) to the refrigerant liquid in the reservoir (10), and a fourth refrigerant path (29), from the second port (12) to the refrigerant gas above the level of the refrigerant liquid in the reservoir (10), open when a refrigerant flows into the reservoir (10) through the second port (12).

According to the invention claimed in claim 2, first to fourth check valves (17, 18, 26, 27), which allow one-directional flow of refrigerant, are provided in the first to fourth refrigerant path (19, 20, 28, 29), respectively.

The first check valve (17) allows one-directional flow of refrigerant from the refrigerant liquid, collected in the reservoir (10), to the first port (11).

The second check valve (18) allows one-directional flow of refrigerant from the first port (11) to the refrigerant gas above the level of the refrigerant liquid within the reservoir (10).

The third check valve (26) allows one-directional flow of refrigerant from the refrigerant liquid, 10 collected in the reservoir (10), to the second port (12).

The fourth check valve (29) allows one-directional flow of refrigerant from the second port (12) to the refrigerant gas above the level of the refrigerant liquid within the reservoir (10).

According to the invention claimed in claim 3, in the gas-liquid separator claimed in claim 1, the first and third refrigerant paths (19, 28) join together at an opening (36*a*) which is provided to open into the refrigerant liquid in the reservoir (10). A switching valve (41) is provided, at the confluent of the first and third refrigerant paths (19, 28), for switching the first and third refrigerant path (19, 28).

The switching valve (41) allows fluid communication of the third refrigerant path (28) when a refrigerant flows into the reservoir through the first port (11) and the fluid communication of the first refrigerant path (19) when a refrigerant flows into the reservoir (10) through the second port (12).

According to the invention claimed in claim 4, the gas-liquid separator according to any one of claims 1–3, the second and fourth refrigerant paths (20, 29) join together at an opening (35*a*) which is provided to open into the refrigerant gas above the level of the refrigerant liquid in the reservoir (10).

A switching valve (38) is provided, at the confluent of the second and fourth refrigerant paths (20, 29), for switching the second and fourth refrigerant path.

The switching valve (38) allows the fluid communication of the second refrigerant path (20) when a refrigerant flows into the reservoir (10) through the first port (11) and the fluid communication of the fourth refrigerant path (29) when a refrigerant flows into the reservoir (10) through the second port (12).

According to the invention claimed in claim 5, in the gas-liquid separator according to any one of claims 1–4, the reservoir (10) has a cylindrical side wall, and the openings (16, 25, 35) among those (11, 12, 16, 25, 35) of the second and fourth refrigerant paths (20, 29) open into the refrigerant gas above the level of the refrigerant liquid in the reservoir (10) are oriented so that the refrigerant from the openings flows along the cylindrical wall of the reservoir.

According to the invention claimed in claim 6, a heat pump type air conditioning system using a gas injection cycle is provided. In the gas injection cycle, refrigerant gas, which is separated from refrigerant in a gas-liquid two-phase flow by using a gas-liquid according to any one of claims 1–6, is compressed by a compressor.

According to the invention claimed in claims 1–6, since the separator can reverse the flow direction within the separator, a heat pump type air conditioning system, which can switch its mode of operation between cooling and heating modes, can be realized without any check valves on outside of the separator in the refrigerant circuit. Therefore, the piping arrangement of a heat pump type air conditioning system using a gas-injection cycle can be simplified, which reduces the assembly cost.

Further, the simplified piping arrangement provides a compact heat pump type air conditioning system using a gas-injection cycle.

According to the invention claimed in claim 3 or claim 4, the number of the parts compared with a gas-liquid separator which requires four check valves is reduced since switching the refrigerant paths in the reservoir results in the refrigerant flow in the reservoir reversing in its flow direction whereby the production cost is reduced.

According to the invention claimed in claim 5, the separation of the refrigerant gas is promoted by a centrifugal force since the openings, in the refrigerant gas, of the second and fourth refrigerant path are oriented so that the refrigerant flows along the side wall of the cylindrical reservoir (10).

DESCRIPTION OF THE DRAWINGS

These and other objects and advantages and further description will now be discussed in connection with the drawings in which.

DESCRIPTION OF THE PREFERRED EMBODIMENTS

Figure 1:
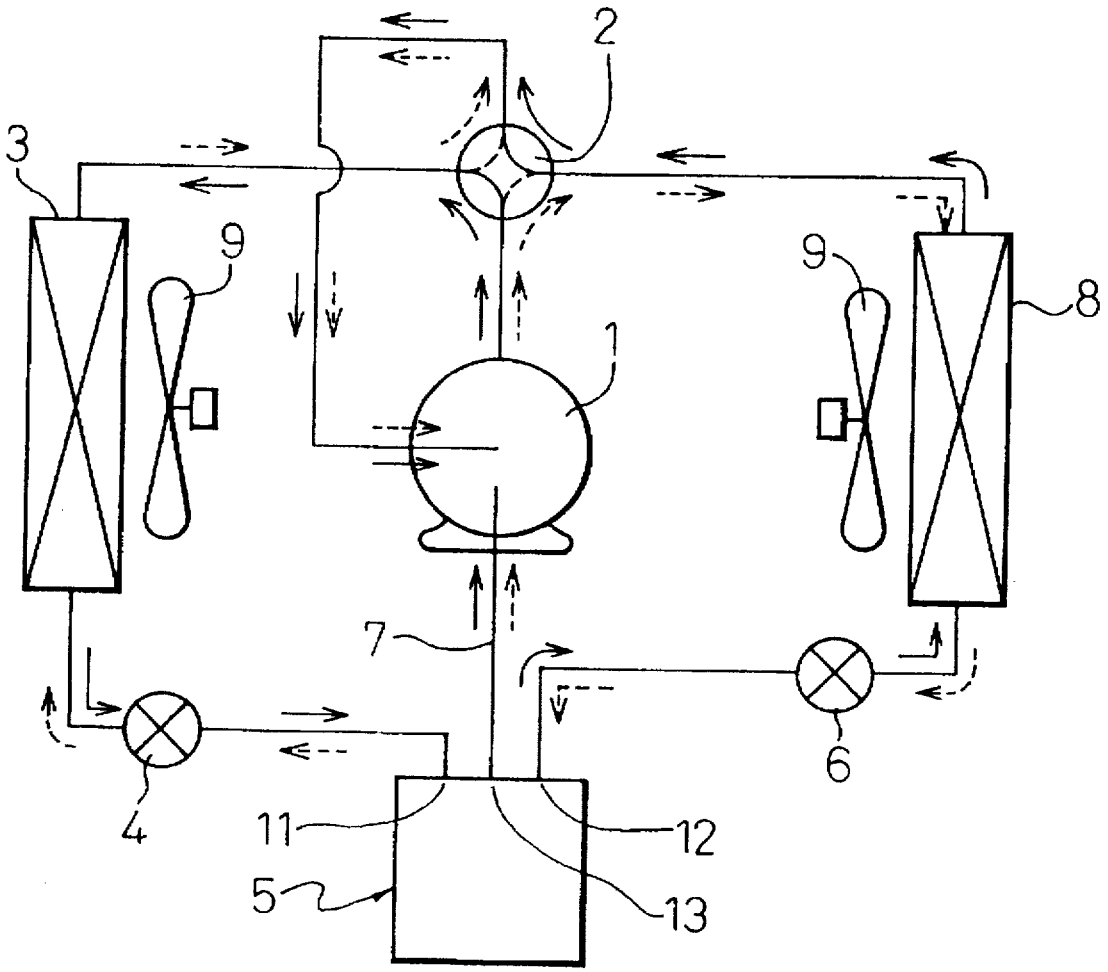
FIG. 1 is a schematic diagram of a heat pump type air conditioning system using a gas-injection cycle using a gas-liquid separator according to the invention.

With reference to FIGS. 1–4, the first embodiment of the invention will be described. FIG. 1 is a schematic circuit diagram of a heat pump type air conditioning system, using a gas-injection cycle, to which a gas-liquid separator according to the invention is applied. The air conditioning system comprises a compressor 1 for compressing refrigerant. The compressor 1 is provided with a switching valve 2, at a discharge port (not shown), for switching the flow direction of the refrigerant in the circuit.

When the switching valve 2 is at a position illustrated, that is, the air conditioning system is in a cooling mode of operation, the refrigerant compressed by the compressor 1 is cooled by an external heat exchanger 3, and is directed to a first pressure reducing valve or a first expansion valve 4. The refrigerant is supplied to a gas-liquid separator 5 after it is decompressed and converted into a gas-liquid two-phase flow at the first expansion valve 4. The refrigerant in a gas-liquid two-phase flow is separated into a refrigerant gas and a refrigerant liquid within the gas-liquid separator 5. The separated refrigerant gas is directed to a suction port of the compressor 1 through conduit 7. The remaining refrigerant liquid is further decompressed at a second expansion valve 6, and directed to the suction port of the compressor 1 through an internal heat exchanger 8 where a heat exchange with air inside a compartment is carried out to cool the air.

On the contrary, when the air conditioning system is in a heating mode of operation, the refrigerant compressed by the compressor 1 is directed to the internal heat exchanger 8 from the switching valve 2 as shown by the broken line, cooled by the heat exchange with the air in the compartment, that is, it heats the air, and is directed to the gas-liquid separator 5 through the second expansion valve 6. Within the gas-liquid separator 5, the refrigerant in a gas-liquid two-phase flow is separated into refrigerant gas and refrigerant liquid. The refrigerant gas is directed to the suction port of the compressor 1 through the conduit 7, and compressed again. The remaining refrigerant liquid is further decompressed at the first expansion valve, and directed to the suction port of the compressor 1 through the external heat exchanger 3 where the refrigerant liquid is heated by a heat exchange. The external and internal heat exchangers 3 and 8 are provided with fan motor assemblies 9 for promoting the heat exchange.

Figure 2:
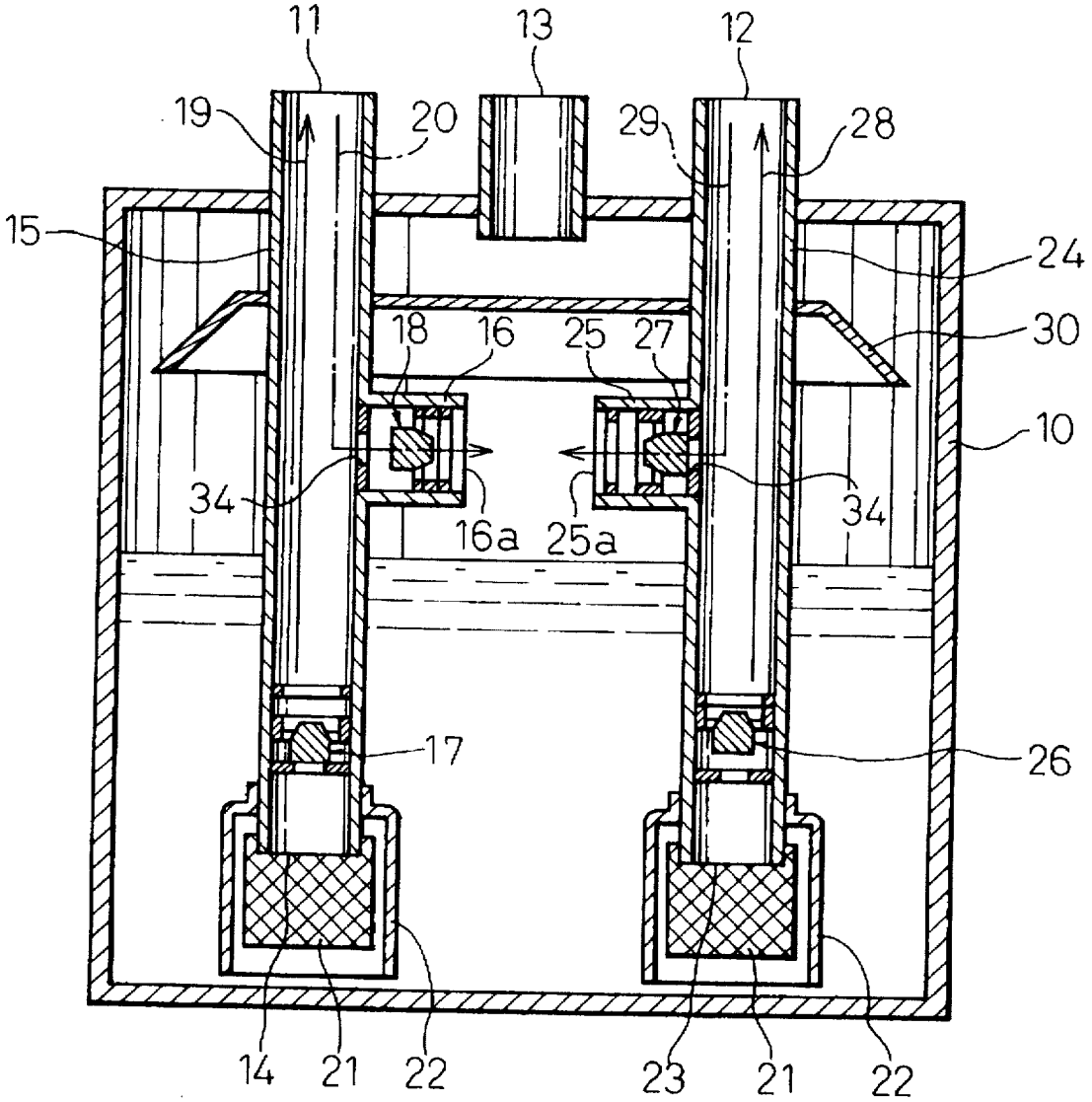
FIG. 2 is a section of a gas-liquid separator according to the first embodiment of the invention.

With reference to FIG. 2, the gas-liquid separator 5 will be described in detail. The gas-liquid separator 5 comprises substantially a cylindrical reservoir 10 made of aluminum. Provided at the upper portion of the reservoir 10 are first and second ports 11 and 12, through which a refrigerant flows in and out, and an exit port 13 through which a separated gas refrigerant flows out. The first and second ports 11 and 12 are fluidly connected to the first and second expansion valves 4 and 6, respectively. The exit port 13 is fluidly connected to the suction port of the compressor 1 through the conduit 7.

A first conduit 15 extends downwardly from the first port 11 to a position adjacent to a bottom wall of the reservoir 10. The first conduit 15 has a branch conduit 16 which extends substantially horizontally. Within the first conduit 15, a check valve 17 is provided adjacent to a lower end opening 14, which valve 17 allows only a flow from the lower end opening 14 toward the first port 11. Similarly, within the branch conduit 16 a check valve 18, identical to the check valve 17, allows a flow from the first port to an end opening 16*a* of the branch conduit 16. Thus, a first flow path, which is indicated by an arrow 19, is provided from the lower end opening 14 to the first port 11, and a second flow path, which is indicated by an arrow 20, is provided from the first port toward the end opening 16*a*.

A second conduit 24 downwardly extends from the second port 12 to a position adjacent to the bottom wall of the reservoir 10. The second conduit 24 has a branch conduit 25 which extends substantially horizontally. Within the second conduit 24, a check valve 26 identical to the check valve 17 is provided adjacent to a lower end opening 23, which valve 26 allows only a flow from the lower end opening 23 toward the second port 12. Similarly, within the branch conduit 25 a check valve 27, identical to the check valves 17 and 26, allows a flow from the second port to an end opening 25*a* of the branch conduit 25. Thus, a third flow path, which is indicated by an arrow 28, is provided from the lower end opening 23 to the second port 12, and a fourth flow path, which is indicated by an arrow 29, is provided from the second port toward the end opening 25a.

As shown in FIG. 2, when the air conditioning system normally operates, the lower end openings 14 and 23 of the first and second conduits 14 and 24 are under the level of the refrigerant liquid contained in the reservoir, and the end openings of the first and second branch conduits 16 and 25 above the level. Strainers 21 of a plastic or metallic material are provided, at the lower end openings 14 and 23 of the first and second conduits 15 and 24, to prevent foreign bodies from entering the refrigerant circuit. Further, plastic covers 22 is provided, at the lower end openings 15 and 24 of the first and second conduits 14 and 23, for enclosing the strainers.

The branch conduits 16 and 25 are inwardly oriented so that the respective end openings 16a and 25a face to each other. further, a shroud 30 of a plastic material is provided over the branch conduits 16 and 25 within the reservoir 10 for preventing refrigerant liquid from being entrained by refrigerant gas flowing out through the exit port 13.

Figure 3:
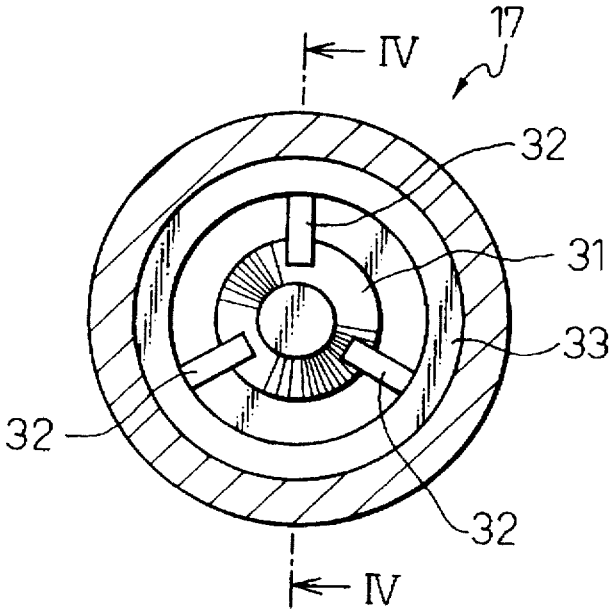
FIG. 3 is an end view of a check valve along line III—III in FIG. 4.
Figure 4:
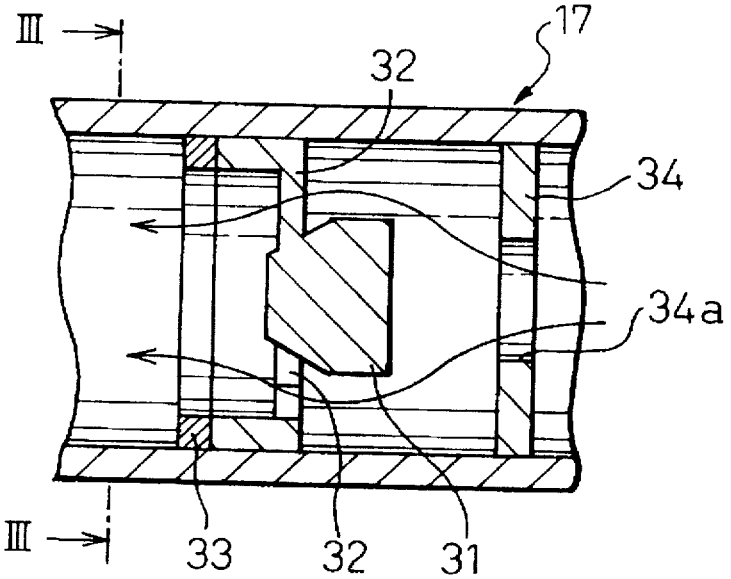
FIG. 4 is a section of the check valve along line IV—IV in FIG. 3.

With reference to FIGS. 3 and 4, the check valves 17, 18, 26 and 27 will be described. These check valves are identical to each other, therefore, only the check valve 17 is described.

The check valve 17 substantially comprises a cylindrical valve body 31 with a tapered end, a valve seat plate 34 including a center opening 34a, and a stopper 33 in the form of a ring. The valve seat 34 and the stopper 33 are separated by a predetermined distance and secured to the inner surface of the first conduit 15 with the valve body 31 being slidable therebetween. The valve body 31 is supported by three supports 32, which are provided equally about the axis thereof, and slidable in the axial direction. Each of the supports 32 is formed into a L shape which has an axial portion which axially extends to contact the inner surface of the first conduit 15, and a radial portion which radially extends between the axial portion and the valve body. The radial portions are connected, at the inner ends thereof, to the tapered portion of the valve body 31, and at the outer ends thereof, to the respective axial portions. The axial portions extend, opposite to the end connected to the radial portions, beyond the end of the tapered portion of the valve body 31.

Thus, the valve body 31 is supported by the three supports 32 to be aligned to the axis of the first conduit 15, and axially slidable within the first conduit 15 between a first position where the valve body 31 abut the valve seat plate 34, and a second position where the ends of the axial portions of the L shaped supports 32 abuts the stopper plate 34. The central opening 34a of the valve seat plate 34 has a diameter smaller than that of the valve body 31. Thus, the central opening 34a is closed by the valve body 31 to prevent the refrigerant from flowing therethrough when the valve body 31 moves to right in FIG. 4 to abut the valve seat plate 34 at the first position. The valve body 31 stops away from the stopper 33 when the valve body 31 moves to left in FIG. 4 so that the ends of the axial portions of the L shaped supports 32 abut the stopper ring 33 at the second position. Thus, the refrigerant flows around the valve body 31 through the central opening 34a of the valve seat plate 34 as shown by arrows in FIG. 4.

With reference to FIGS. 1 and 2, the operation of the gas-liquid separator 5 will be described.

When the air conditioning system of FIG. 1 is in a cooling mode of operation, a refrigerant is compressed by the compressor 1, and flows, as a gas-liquid two-phase flow, into the reservoir 10 through the first port 11 after passing through the external heat exchanger 3 and the first expansion valve 4. On that occasion, the valve body 31 of the check valve 17 in the first conduit 15 moves to the first position, due to the flow of the refrigerant, which closes the check valve 17. On the other hand, the valve body of the check valve 18 in the branch conduit 16 of the first conduit 15 moves to the second position to allow the refrigerant to flow therethrough into the reservoir 10 over the level of the refrigerant liquid. Refrigerant liquid is separated from the gas-liquid two-phase flow of refrigerant entering the reservoir 10 so that the refrigerant liquid falls to the lower part of the reservoir 10 due to gravity. The refrigerant gas separated from the liquid-gas two-phase flow of refrigerant is directed to the suction port of the compressor 1 through the exit port 13 and the conduit 7. At this same time, the valve body of the check valve 26 in the second conduit 24 is in the second position and the valve body of the check valve 27 in the branch conduit 25 of the second branch conduit 24 is in the first position. Thus, the refrigerant liquid within the lower portion of the reservoir 10 is driven, by the pressure of the refrigerant entering through the first port 11, to the second expansion valve 6 through the second conduit 24 and the second port 12, as shown by an arrow 28.

Contrarily, when the air conditioning system of FIG. 1 is in a heating mode of operation, the refrigerant, compressed by the compressor 1, enters the reservoir 10 through the internal heat exchanger 38, the second expansion valve 6 and the second port 12. At this time, the valve body of the check valve 26 in the second conduit 24 moves into the first position, due to the flow of the refrigerant, to block the check valve 26. The valve body of the check valve 27 in the branch conduit 25 of the second conduit 24 moves to the second position to allow the flow of the refrigerant so that the refrigerant flows into the upper position of the reservoir 10 above the level of the refrigerant liquid. Refrigerant liquid is separated from the gas-liquid two-phase flow of refrigerant entering the reservoir 10 so that the refrigerant liquid falls to the lower part of the reservoir 10 due to gravity. The refrigerant gas separated from the liquid-gas two-phase flow of refrigerant is directed to the suction port of the compressor 1 through the exit port 13 and the conduit 7. At this same time, the valve body of the check valve 17 in the first conduit 15 is in the second position and the valve body of the check valve 18 in the branch conduit 16 of the first conduit 15 is in the first position. Thus, the refrigerant liquid within the lower portion of the reservoir 10 is driven, by the pressure of the refrigerant entering through the second port 12, to the first expansion valve 3 through the first conduit 15 and the first port 11, as shown by an arrow 19.

As mentioned above, the gas-liquid separator 5 according to the first embodiment of the invention provides a heat pump type air conditioning system which can switch its mode of operation between cooling and heating modes without any check valves provided on the outside of the separator in the refrigerant circuit since the separator can reverse the flow direction of the refrigerant within the separator. Therefore, the piping arrangement of a heat pump type air conditioning system using a gas-injection cycle can be simplified, which reduces the assembly cost.

Figure 5:
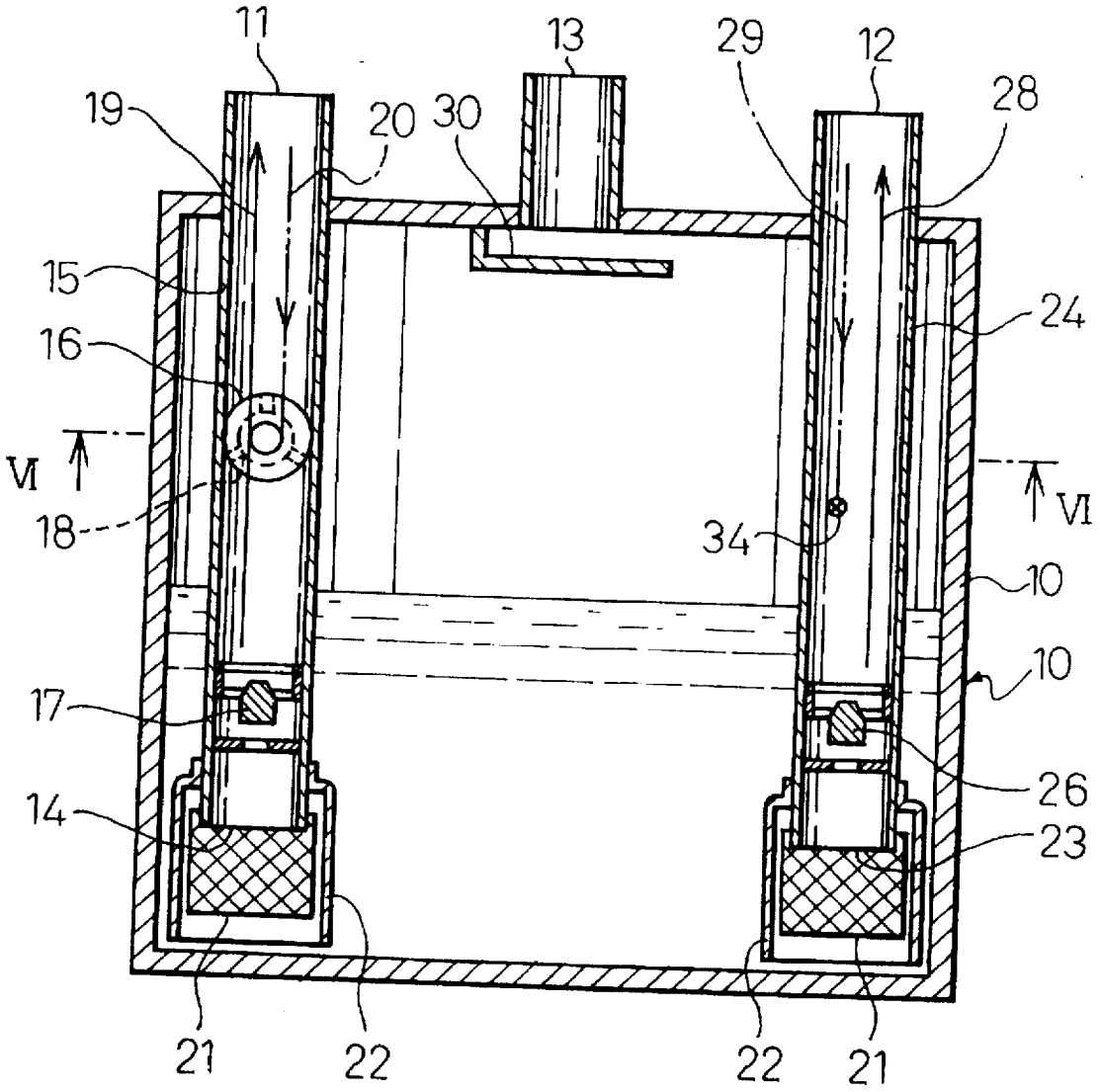
FIG. 5 a section of a gas-liquid separator according to the second embodiment of the invention.
Figure 6:
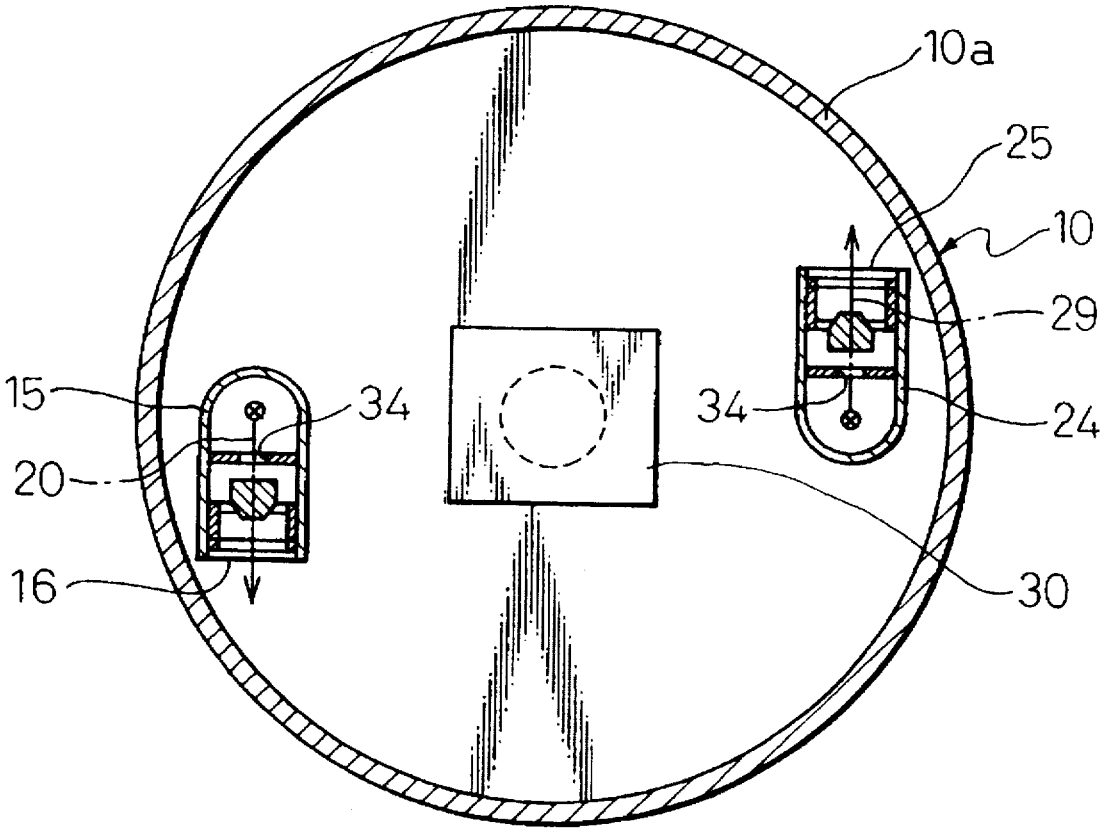
FIG. 6 is a section of the gas-liquid separator along line VI—VI in FIG. 5.

With reference to FIGS. 5 and 6, the second embodiment of the invention will be described. In FIGS. 5 and 6, elements similar to those of the embodiment of FIGS. 2–4 are indicated by the same reference numbers.

A gas-liquid separator 5 according to the second embodiment, comprises a cylindrical reservoir 10. Branch conduits 16 and 25 of the first and second conduits 15 and 24 are oriented substantially along the circumferential direction so that a swirl flow is formed by the refrigerant flow from the respective openings 16a and 25a of the branch conduits 16 and 25 of the first and second conduits 15 and 24. When the refrigerant in a gas-liquid two-phase flow enters the reservoir 10 through the first port 11 or second port 13, the refrigerant flows along the inner circumferential wall to generate a two-phase swirl flow within the reservoir 10. Thus, the centrifugal force acts on the two phase flow as well as gravity, which results in the refrigerant liquid moving radially outwardly and attaching to the wall so that the refrigerant gas and liquid are separated from each other. The refrigerant liquid attaching to the wall flows downwardly along the wall and collects at the lower part of the reservoir 10. Thus, the separating performance of the separator 5 is increased. The increased performance of the separator 5 allows the size of the shroud 30 to be reduced.

With reference to FIGS. 7–10, the third embodiment of the invention will be described. In FIGS. 7–10, the similar elements are also indicated by the same reference number as above-described embodiments.

In the third embodiment, the first and second conduits 15 and 24 are connected to each other by first and second confluent conduits 37 and 40. Provided at the longitudinally center portion of the first confluent conduit 37 is an opening 35a to which a horizontally extending discharge conduit 35 is connected. Connected to the second confluent conduit 40 is a suction conduit 36 which downwardly extends from the second conduit. In particular, the suction conduit 36 includes an opening 36a, and extends from the second confluent conduit 40 to a position lower than the level of the refrigerant liquid contained within the reservoir 10. A strainer 21 and a cover 22 are provided at the end of the suction conduit 36. Spools 38 and 41 are provided to slide within the first and second confluent conduits 37 and 40.

The spools 38 and 41 have a same configuration, and they include stems 38b and 41b to which either ends flanges 38a and 41a are connected. The flanges 38a and 41a include cut out portions 38c and 41c which are equally spaced at an angle along the circumference thereof. Secured to the inside of the first confluent conduit 37 are a pair of valve seat plates 39, with central openings 39a, at a distance from each other, between which the spool 38 is slidable. Abutment of the spool 38 against one of the pair of valve seat plates 39 closes its central opening 39a.

At substantially the center portion of the second confluent conduit 40, a pair of valve plates 42 with central openings 42a are secured to the inside of the second confluent conduit 40 at a distance from each other smaller than that between the flanges 41a of the spool 41. The central openings 42a have an inner diameter larger than the outer diameter of the stem 41b of the spool 41. The stem 41b of the spool 41 passes through the central openings 42a so that the inner faces of the flanges 41a can contact the outer end faces of the respective valve plates 42. Thus, abutment of the spool 41 against one of the valve plates 42 closes its central opening 42a.

Figure 7:
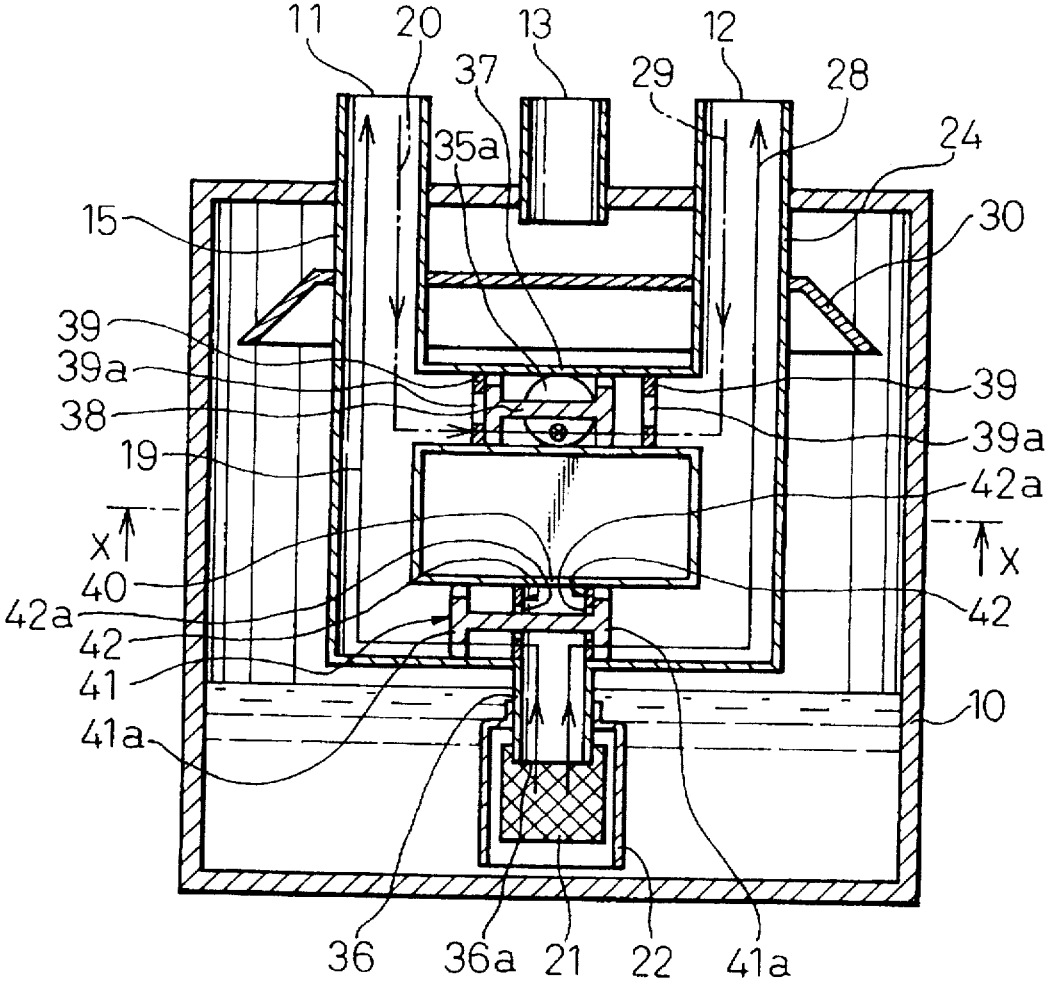
FIG. 7 is a section of a gas-liquid separator according to the third embodiment of the invention.
Figure 8:
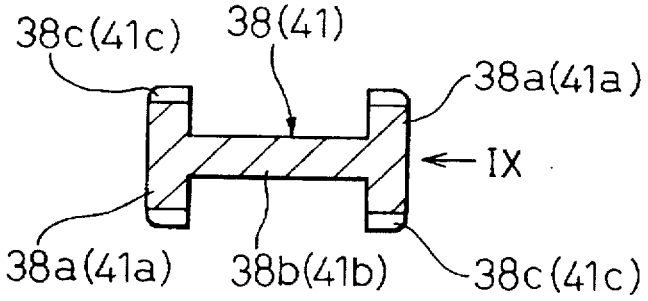
FIG. 8 is section of a spool of a switching valve of the gas-liquid separator of FIG. 7 along line VIII—VIII in FIG. 9.
Figure 9:
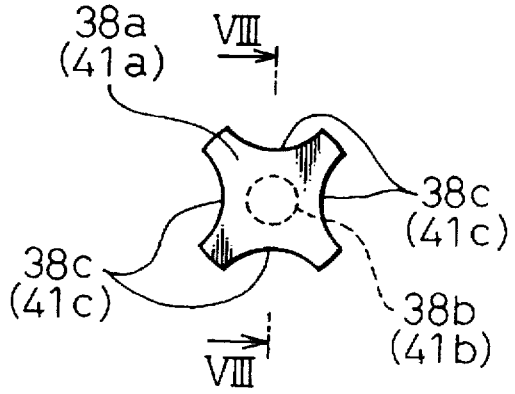
FIG. 9 is an end view of the separator along line IX—IX in FIG. 8.
Figure 10:
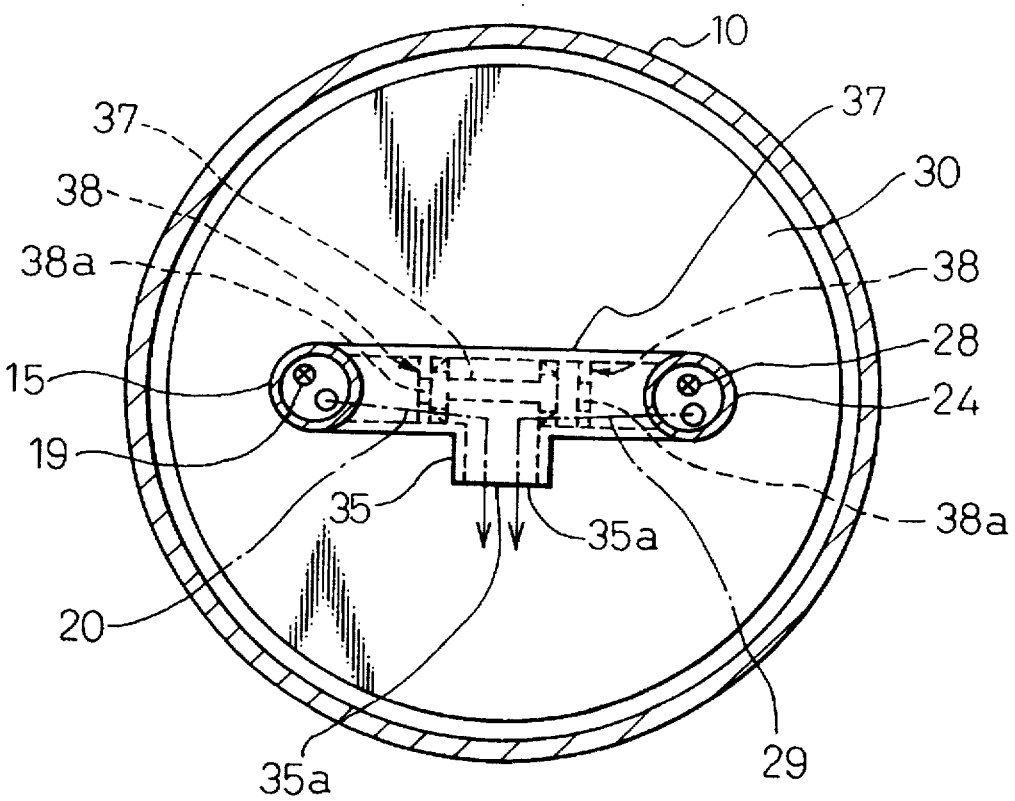
FIG. 10 is a section of the gas-liquid separator along line X—X in FIG. 7.

FIG. 7 shows the air conditioning system in FIG. 1 in a heating mode of operation, in which refrigerant in a gas-liquid two-phase flow is supplied through the second port 12. The pressure of the refrigerant through the second port 12 drives the spool 38 and 41 to left in FIG. 7. Thus, in the first confluent conduit 37, the left valve plate is closed and the right valve plate is opened while, in the second confluent conduit 40, the left valve plate is opened and the right valve plate is closed. Thus, the refrigerant in a gas-liquid two-phase flow flows through the second port 12 and enters the reservoir 10 through the second conduit 24 and the discharge conduit, as shown by dashed line and arrow 29, to separate into gas and liquid. The refrigerant gas is directed to the suction port of the compressor 1 through the exit port 13 while the refrigerant liquid is collected within the lower part of the reservoir 10. The refrigerant liquid collected within the lower part of the reservoir 10 is driven, by the pressure of the refrigerant entering the reservoir 10, to the first expansion valve 3 through the suction conduit 36, the first conduit 15 and the first port 11, as shown by solid line and arrow 19.

Figure 11:
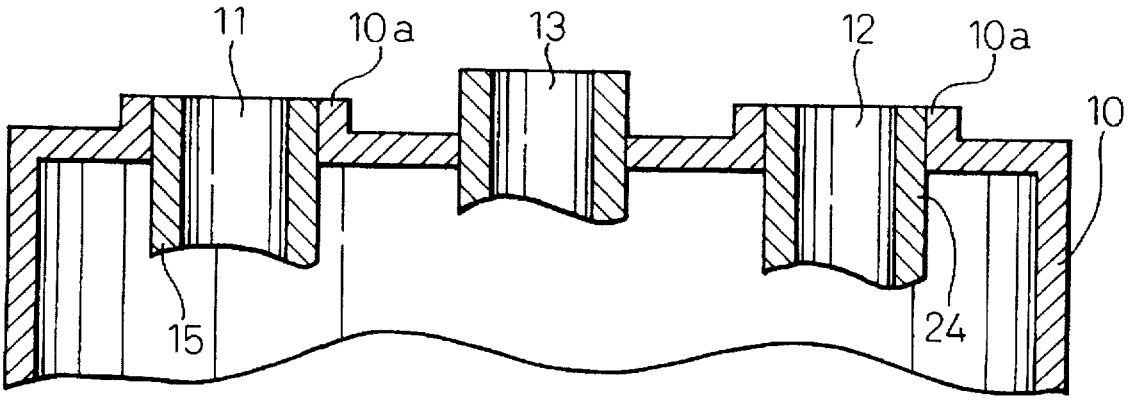
FIG. 11 is an enlarged partial section of a reinforcement arrangement for ports.

In order to reinforce the joins between the reservoir 10 and the first and second conduits 15 and 24, ribs 10a in the form of rings can be provided to the reservoir 10 as shown in FIG. 11.

The preferred embodiments of the invention were described above. However, it will also be understood by those skilled in the art that various changes and modifications may be made without departing from the spirit and scope of the invention.

We claim:

1. A gas-liquid separator for a heat pump type air conditioning system using a gas-injection cycle, the air conditioning system being able to switch its mode of operation between heating and cooling modes, comprising:

a reservoir for receiving gas-liquid two-phase flow of refrigerant;

an exit port, opening at a upper portion of the reservoir, for allowing a refrigerant gas to flow out of the reservoir;

first and second ports provided, at a upper part within the reservoir above the level of a refrigerant liquid, for allowing the refrigerant to flow into and out of the reservoir;

a first refrigerant path provided, within the reservoir, for allowing the first port to fluidly communicate with the refrigerant liquid in the reservoir;

a second refrigerant path provided, within the reservoir, for allowing the first port to fluidly communicate with the refrigerant gas above the level of the refrigerant liquid in the reservoir;

a third refrigerant path provided, within the reservoir, for allowing the second port to fluidly communicate with the refrigerant liquid in the reservoir;

a fourth refrigerant path provided, within the reservoir, for allowing the second port to fluidly communicate with the refrigerant gas above the level of the refrigerant liquid in the reservoir; and the second and third refrigerant paths opening when a refrigerant enters the reservoir through the first port, and the first and fourth refrigerant paths opening when a refrigerant enters the reservoir through the second port.

2. A gas-liquid separator according to claim 1, further comprising first to fourth check valves provided, in the first to fourth refrigerant path respectively, for allowing one-directional flow of refrigerant;

the first check valve allowing one-directional flow of refrigerant from the refrigerant liquid to the first port;

the second check valve allowing one-directional flow of refrigerant from the first port to the refrigerant gas above the level of the refrigerant liquid;

the third check valve allowing one-directional flow of refrigerant from the refrigerant liquid to the second port; and the fourth check valve allowing one-directional flow of refrigerant from the second port to the refrigerant gas above the level of the refrigerant liquid.

3. A gas-liquid separator according to claim 1, in which the first and third refrigerant paths join together at an opening provided to open into the refrigerant liquid;

a switching valve provided, at the confluent of the first and third refrigerant paths, for switching the first and third refrigerant path; and the switching valve allowing the fluid communication of the third refrigerant path when a refrigerant flows into the reservoir through the first port, and the fluid communication of the first refrigerant path when a refrigerant flows into the reservoir through the second port.

4. A gas-liquid separator according to claim 3, in which the second and fourth refrigerant paths join together at an opening provided to open into the refrigerant gas above the level of the refrigerant liquid;

a switching valve provided, at the confluence of the second and fourth refrigerant paths, for switching the second and fourth refrigerant path; and the switching valve allowing the fluid communication of the second refrigerant path when a refrigerant flows into the reservoir through the first port, and the fluid communication of the fourth refrigerant path when a refrigerant flows into the reservoir through the second port.

5. A gas-liquid separator according to claim 1, in which the reservoir comprises a cylindrical side wall; and the openings among those of the second and fourth refrigerant paths, which open into the refrigerant gas above the level of the refrigerant liquid, being circumferentially oriented relative to the reservoir.

6. A gas-liquid separator according to claim 2, in which the reservoir comprises a cylindrical side wall; and the opening among those of the second and fourth refrigerant paths, which open into the refrigerant gas above the level of the refrigerant liquid, being circumferentially oriented relative to the reservoir.

* * * * *